US006109949A

United States Patent [19]

Suzuki et al.

[11] Patent Number: 6,109,949

[45] Date of Patent: Aug. 29, 2000

[54] CONNECTOR ASSEMBLY INCLUDING A HEADER CONNECTOR AND A SOCKET CONNECTOR

[75] Inventors: Masao Suzuki, Tokyo; Izuru Kumagai, Kawasaki, both of Japan

[73] Assignee: Thomas & Betts Corporation, Memphis, Tenn.

[21] Appl. No.: 08/945,713

[22] PCT Filed: Apr. 24, 1996

[86] PCT No.: PCT/JP96/01111

§ 371 Date: Oct. 20, 1997

§ 102(e) Date: Oct. 20, 1997

[87] PCT Pub. No.: WO96/34430

PCT Pub. Date: Oct. 31, 1996

[51] Int. Cl.[7] ..... H01R 13/64

[52] U.S. Cl. ..... 439/374; 439/682

[58] Field of Search ..... 439/374, 31, 660, 439/682, 287

[56] References Cited

U.S. PATENT DOCUMENTS

| | | | |
|---|---|---|---|
| 4,632,475 | 12/1986 | Tomita | 439/31 |
| 4,715,819 | 12/1987 | Iwasa et al. | 439/31 |
| 4,877,409 | 10/1989 | Tanigawa et al. | 439/31 |
| 4,975,062 | 12/1990 | Evans et al. | 439/31 |
| 5,727,961 | 3/1998 | Landis et al. | 439/287 |

FOREIGN PATENT DOCUMENTS

| | | |
|---|---|---|
| 079 665 | 5/1983 | European Pat. Off. . |
| 62-116377 | 7/1987 | Japan . |
| 04-066795 | 6/1992 | Japan . |

*Primary Examiner*—Gary F. Paumen
*Assistant Examiner*—Katrina Davis
*Attorney, Agent, or Firm*—Hoffman & Baron, LLP

[57] ABSTRACT

A connector comprises a header having a plurality of contacts mounted thereon in such a manner that the post portions thereof protrude outwardly, and a socket having mounted thereon a plurality of contacts for contacting with the respective post portions of the header and being electrically connected thereto. The socket further has a plurality of guide grooves for receiving the respective post portions of the header thereinto and guiding them to the corresponding contacts of the socket. The guide grooves form slots thin enough to be broken when receiving the post portions thereinto or sufficiently narrower than the width of the post portions. Those regions of the contacts of the socket which contact with the post portions are provided so as not to be exposed outwardly of the socket.

7 Claims, 5 Drawing Sheets

CONNECTOR ASSEMBLY INCLUDING A HEADER CONNECTOR AND A SOCKET CONNECTOR

TECHNICAL FIELD

This invention relates to a connector, and particularly to a connector for connecting a battery unit.

BACKGROUND ART

Among connectors of this kind, the popular type in which the contact of a male type connector or a female type connector or the contacts of connectors of both types are exposed outwardly.

DISCLOSURE OF INVENTION

However, when the number of electrodes becomes great and the distance between the contacts becomes short, the danger of being short-circuited between the contacts becomes correspondingly great. Especially, in a connector attached to a battery unit containing a battery of large capacity therein, a contact leading to the electrode of the battery will suffer from great damage when short-circuiting takes place, and will also be dangerous.

The present invention has as its object to eliminate the above-noted defect peculiar to the connector according to the prior art.

To achieve such object, the present invention provides a connector comprising a header having a plurality of post portions mounted thereon in such a manner as to protrude outwardly, and a socket having mounted thereon a plurality of contacts for contacting with the respective post portions of said header and being electrically connected thereto, said socket further having a plurality of guide grooves for receiving the respective post portions of the header thereinto and guiding them to the corresponding contacts of said socket, said guide grooves forming slots thin enough to be broken when receiving the post portions thereinto or sufficiently narrower than the width of the post portions, these regions of the contacts of said socket which contact with said post portions being provided so as not to be exposed outwardly of said socket.

In the present invention, the contacts of the socket are mounted in the housing of the socket and when the header and the socket fit to each other, the post portions of the header contact with the contacts while breaking or enlarging the guide grooves of the socket.

BEST MODE FOR CARRYING OUT THE INVENTION

Figure 1:
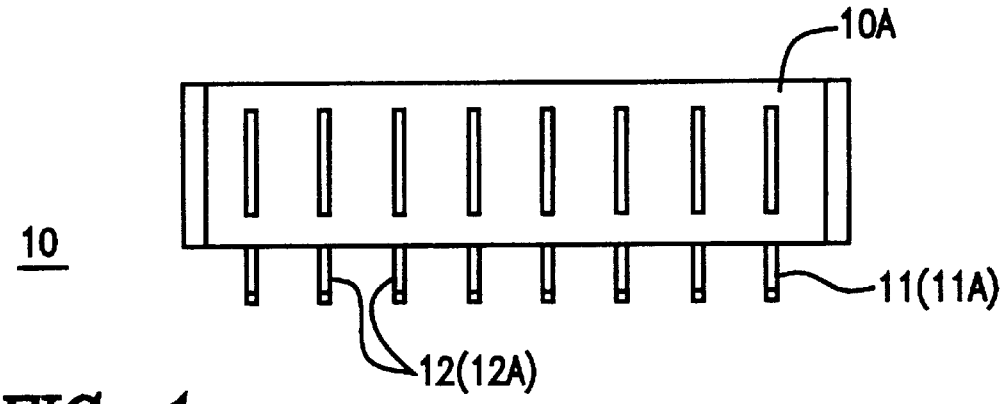
FIG. 1 is a front view showing the header of a connector according to an embodiment of the present invention.

The invention will hereinafter be described with respect to an embodiment thereof shown in the drawings.

Figure 2:
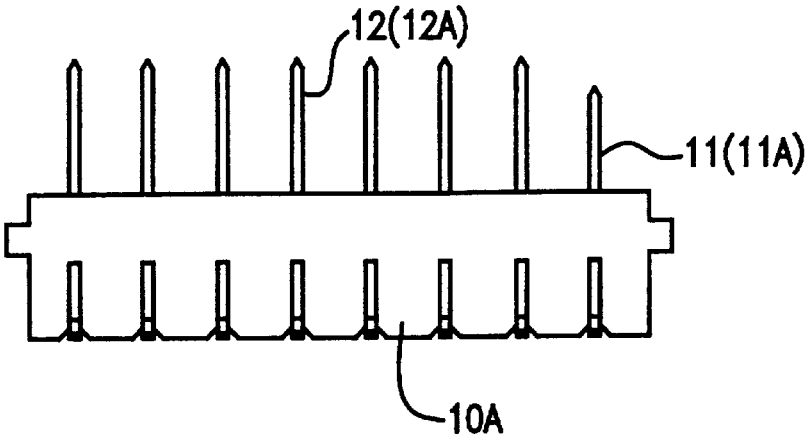
FIG. 2 is a plan view of the header of FIG. 1.
Figure 3:
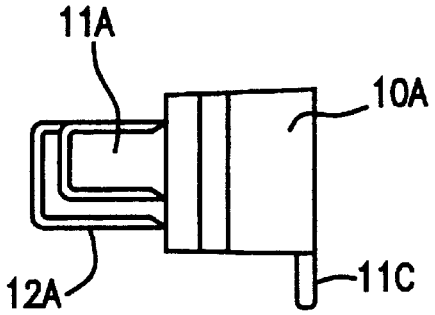
FIG. 3 is a side view of the header of FIG. 1.
Figure 5:
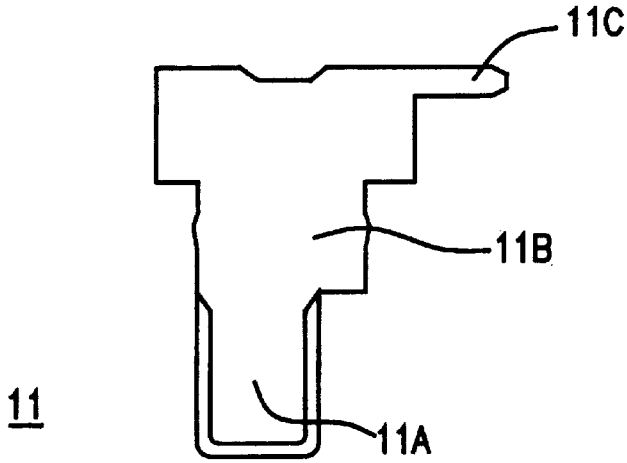
FIG. 5 is a plan view showing a contact (shorter one) used in the header of FIG. 1.
Figure 6:
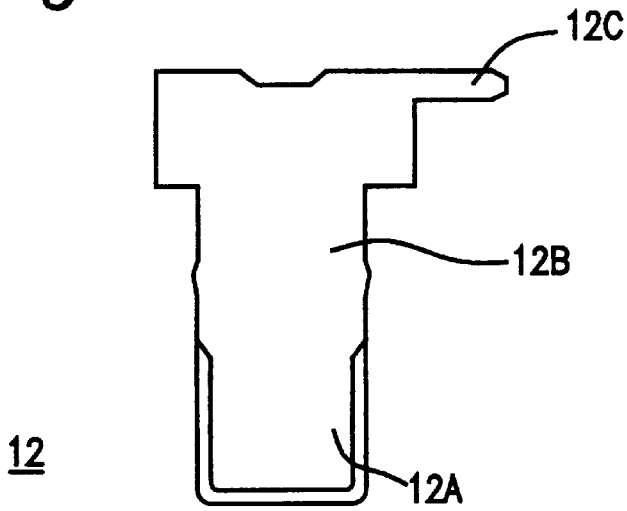
FIG. 6 is a plan view showing a contact (longer one) used in the header of FIG. 1.
Figure 7:
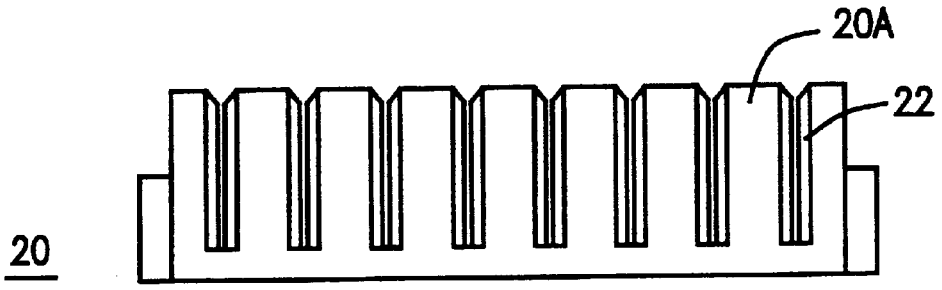
FIG. 7 is a front view showing the socket of the connector according to an embodiment of the present invention.
Figure 8:
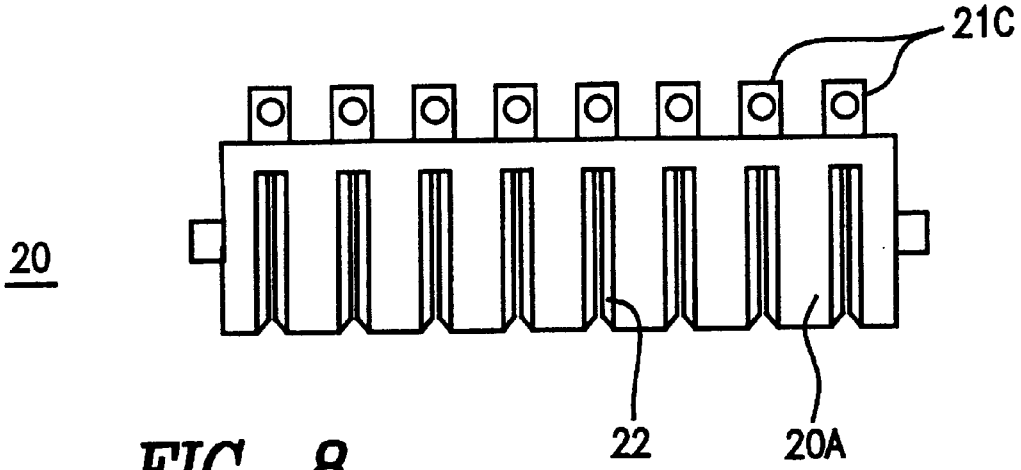
FIG. 8 is a plan view of the socket of FIG. 7.
Figure 9:
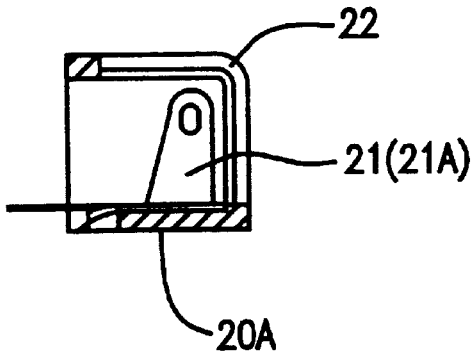
FIG. 9 is a side view of the socket of FIG. 7.

FIGS. 1 to 3 show the header 10 of a connector according to the present invention. The header comprises a housing 10A and a plurality of contacts 11 and 12 mounted so that the post portion thereof may protrude outwardly from the housing, and with predetermined intervals provided in the lengthwise direction of the housing (see FIGS. 1 to 3). The details of the contacts are shown in FIGS. 5 and 6. As can be seen from these figures, the contacts comprise post portions 11A, 12A, leg portions 11C, 12C and connecting portions 11B, 12B connecting these together.

Figure 4:
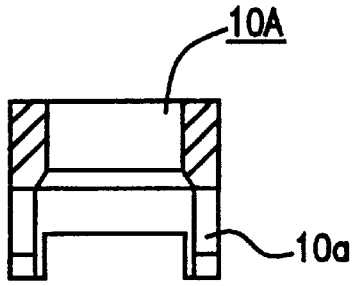
FIG. 4 is a vertical cross-sectional view of the housing of the header of FIG. 1.

The cross-sectional shape of the housing 10A with the post portions removed is shown in FIG. 4. As shown the cross-section thereof has a short leg portion 10*a* provided at its bottom but generally presents a substantially rectangular shape.

As can be seen from FIGS. 2, 5 and 6, at least one (11) of the post portions of the contacts is shorter than the other post portions (12) and the leg portions 11C and 12C of the contacts protrude downwardly from the bottom (leg portion) of the housing. Also, at least one of the post portions has its width made narrower than the width of the other post portions. As regards the position at which the post portions protrude from the housing, that of at least one post portion may be made to differ from that of the other post portions.

FIGS. 7 to 10 show the socket 20 of the connector according to the present invention. The socket comprises a housing 20A and a plurality of contacts 21 for contacting with the respective post portions of the header and being electrically connected thereto. The contacts are mounted with predetermined intervals provided in the lengthwise direction of the housing. Also the contacts are mounted in the housing except terminal portions which will be described later so that the regions thereof contacting with the post portions may not be exposed outwardly of the housing.

Figure 10:
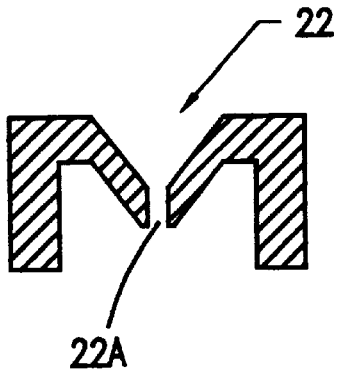
FIG. 10 is a vertical cross-sectional view of the guide groove of the socket of FIG. 7.

The socket further has a plurality of guide grooves 22 for receiving the respective post portions of the header thereinto and guiding them to the corresponding contacts of the socket. These guide grooves form slots 22A which are thin enough to be broken when receiving the post portions therein or sufficiently narrower than the width of the post portions. For example, each of the guide grooves is provided so that, as shown in FIG. 10, the cross-sectional portion thereof may present a substantially M-shape or so that, as can be seen from FIGS. 7 to 9, it may be astride at least two (or three) adjacent surfaces of the housing. In the showing, the opposite side regions of each guide groove with respect to the slot are formed thinly as compared with the other portions of the housing and use a material rich in flexibility to thereby act as a spring.

Figure 11:
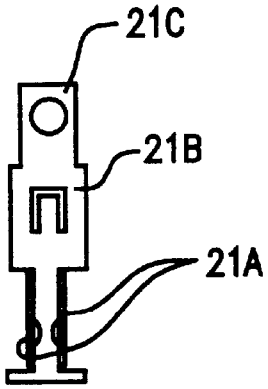
FIG. 11 is a plan view showing a contact used in the socket of FIG. 7.
Figure 12:
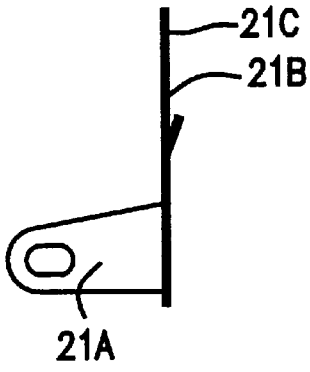
FIG. 12 is a side view showing the contact used in the socket of FIG. 7.

Each of the contacts of the socket, as shown in FIGS. 11 and 12, comprises a pair of contact pieces 21A, a terminal portion 21C and a connecting portion 21B connecting these together. The contact pieces are provided so as to be opposed to each other as shown in order to receive the post portion of the header and sandwich it therebetween.

Figure 13:
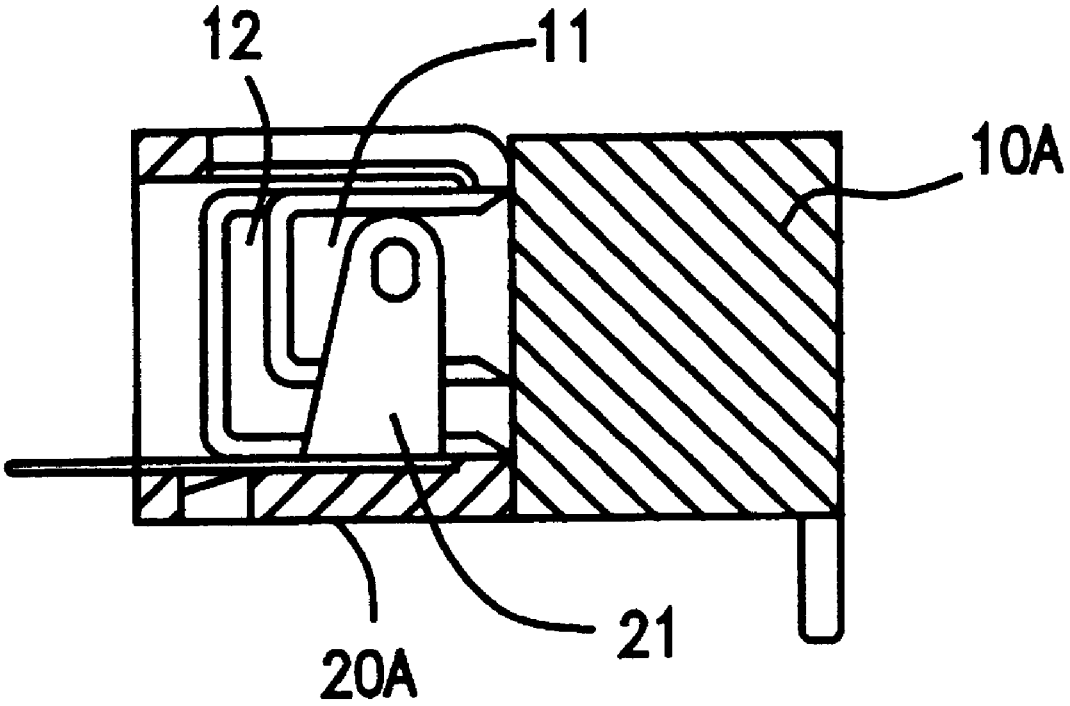
FIG. 13 is a partly cross-sectional view showing the fitted state of the socket and header.

FIG. 13 is a cross-sectional view showing the coupled state of the header and the socket. The post portions of the contacts of the header pass through the guide grooves of the socket and are received and sandwiched between the mutually opposed contact pieces of the socket and electrically connected thereto.

The socket, although not shown, is attached in advance, for example, to a battery unit, and the terminals of the contacts are connected to the electrodes of the unit. Also, the header, although not shown, is mounted, for example, on a printed substrate through the leg portions of the contacts.

In the socket of the present invention, the plurality of guide grooves for receiving the respective post portions of the header thereinto and guiding them to the corresponding contacts of the socket are provided so as to form slots which are thin enough to be broken when receiving the post portions and so that those regions of the contacts of the socket which contact with the post portions of the header may not be exposed outwardly of the socket and therefore, the contact portions of the contacts of the socket are not exposed outwardly of the housing, irrespective of before and after the connection of the socket and the header. Accordingly, even when the socket is attached, for example, to a unit including a battery of large capacity for use, short-circuiting will not take place and the safety in handling will be achieved.

Also, each guide groove is provided so as to be astride at least two adjacent surfaces of the housing of the socket and therefore, it becomes possible for the post portions of the header and the contacts of the socket to be connected so as to become linear with one another or to intersect one another. Accordingly, about the connection of the header and socket, the degree of freedom of the direction of connection is great.

At least one of the post portions of the contacts of the header is shorter than the other post portions and therefore, when the post portions and the contacts of the socket are to be connected together, a difference in the time for connection occurs between the longer post portions and the shorter post portion. Thereby, for example the connection of a ground terminal may be staggered in time so as to take measures such as improving safety. This also holds true of a case where with regard to a header differing in the width of the post portions thereof, the post portions are connected to the contacts of the socket in a direction intersecting the direction of protrusion thereof, and further holds true also of a case where with regard to a header differing in the position of protrusion of the post portions thereof, the post portions are connected to the contacts of the socket in a direction intersecting the direction of protrusion.

What is claimed is:

1. A connector assembly comprising a header 10 including a header housing 10A and a plurality of contacts 11, 12 mounted in said housing in such a manner that post portions 11A, 12A thereof protrude outwardly, and a socket 20 including a socket housing 20A having a plurality of adjacent surfaces and having mounted thereon a plurality of contacts 21 for contacting with the respective post portions of said header and being electrically connected thereto, said socket housing further having a plurality of guide grooves 22 for receiving the respective post portions of the header thereinto and guiding them to the corresponding contacts of said socket, said guide groves of said housing forming slots 22A along at least two of said adjacent surfaces thereof which are sufficiently narrower than the width of the post portions for guiding the post portions thereinto, those regions of the contacts of said socket which contact with said post portions being provided so as not to be exposed outwardly of said socket.

2. A connector according to claim 1 wherein the contacts of said socket each have a pair of mutually opposed contact pieces 21A for receiving and sandwiching the post portion of said header therebetween.

3. A connector according to claim 1 wherein at least one of the post portions of said header is shorter than the other post portions.

4. A connector according to claim 1, wherein at least one of the post portions of said header is smaller width than that of the other post portions.

5. A connector according to claim 1, wherein at least one of the post portions of said header differs from the other post portions in the position at which it protrudes from the housing of the header.

6. A connector according to claim 1, wherein the shape of the housing of the header is substantially rectangular in its cross-section.

7. A connector according to claim 6, wherein said guide grooves present a substantially M-shape in their cross-section.

* * * * *

UNITED STATES PATENT AND TRADEMARK OFFICE

CERTIFICATE OF CORRECTION

PATENT NO. : 6,109,949

DATED : August 29, 2000

INVENTOR(S) : Suzuki et al.

It is certified that error appears in the above-indentified patent and that said Letters Patent is hereby corrected as shown below:

In the title, it incorrectly reads "Connector Assembly Including a Header Connector and a Socket Connector." The title should read - - Connector Assembly With Socket Having Narrow Guide Grooves and Unexposed Contacts. - -

Signed and Sealed this

Fifteenth Day of May, 2001

*Attest:*

Nicholas P. Godici

NICHOLAS P. GODICI

*Attesting Officer*

*Acting Director of the United States Patent and Trademark Office*